United States Patent [19]

Kennedy

[11] Patent Number: 4,748,966

[45] Date of Patent: Jun. 7, 1988

[54] SELF-REGULATING CONCRETE CUTTING SAW

[76] Inventor: Ralph Kennedy, 8036 Smoke Rd., Pataskala, Ohio 43062

[21] Appl. No.: 927,210

[22] Filed: Nov. 5, 1986

[51] Int. Cl.[4] ..... B28D 1/04

[52] U.S. Cl. ..... 125/14; 51/165.92; 60/426

[58] Field of Search ..... 60/426, 430; 125/14; 51/165.92

[56] References Cited

U.S. PATENT DOCUMENTS

| | | | |
|---|---|---|---|
| 2,488,643 | 11/1949 | Smith | 125/14 |
| 3,877,180 | 4/1975 | Brecker | 51/165.92 |
| 3,975,909 | 8/1976 | McBurnett | 60/430 |
| 4,310,198 | 1/1982 | Destree | 125/14 |
| 4,553,389 | 11/1985 | Tischer | 60/430 |

*Primary Examiner*—Harold D. Whitehead

*Attorney, Agent, or Firm*—John L. Gray

[57] ABSTRACT

A self-propelled concrete cutting saw in which the saw and the self-propelled platform associated with the saw are both driven by hydraulic motors, with the speed of longitudinal movement of the saw through the concrete being controlled by the density of the concrete being cut by the saw so that the saw blade is operated at an optimum rotational speed.

4 Claims, 2 Drawing Sheets

FIG. 1
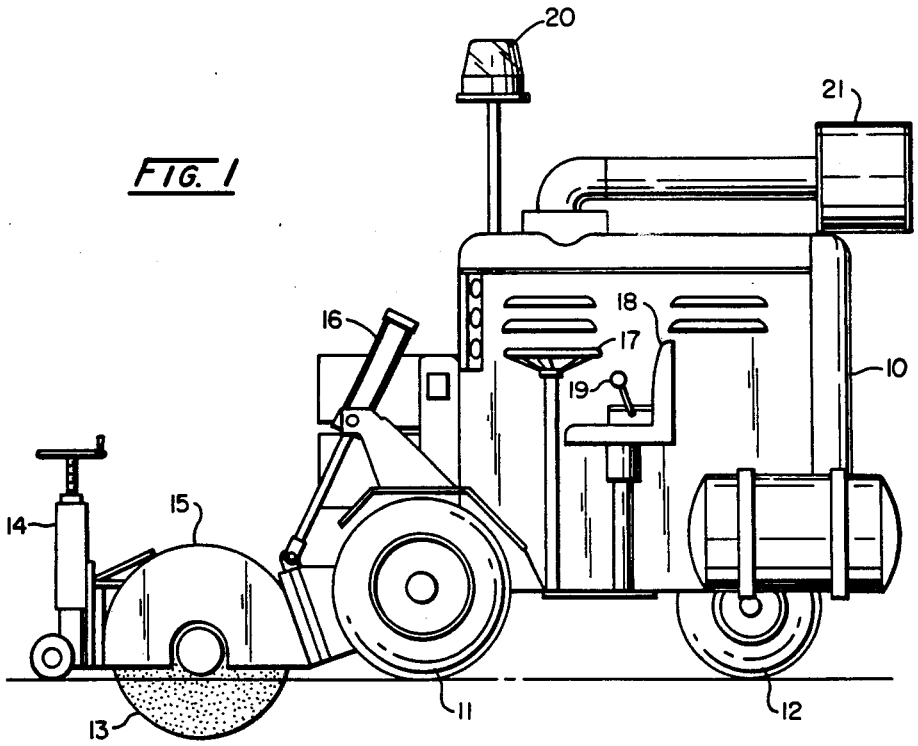
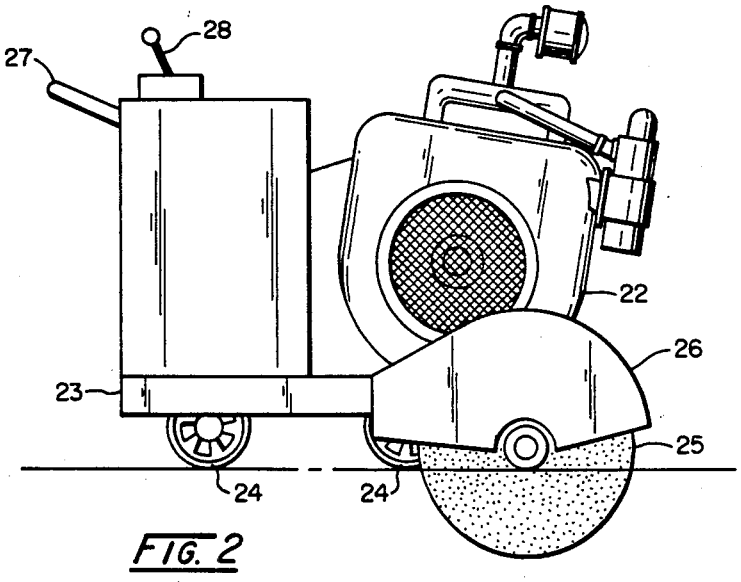
FIG. 2

SELF-REGULATING CONCRETE CUTTING SAW

BACKGROUND OF THE INVENTION

Rotary concrete saws used in construction and repair of highways, airport runways, and large concrete foundations are well known. Usually these are self-propelled units in which an operator walks behind the unit, the longitudinal propulsion of the unit and the rotation of the saw blade being achieved by pulleys connected through suitable gearing systems to a prime mover. The propulsion speed of the device and the rotational speed of the saw blade may be manually controlled by the operator. Concrete will vary in density, depending upon the ingredients used in making the concrete mix and in large area installations, such as highways, airport runways, warehouse floors, etc., the density of the concrete can vary considerably.

In addition, in operating a concrete saw, oftentimes the saw blade will encounter reinforcing bars which must also be cut through and, of course, are far denser than concrete.

In cutting through concrete, it is desirable to have the surface speed of the blade at an optimum amount. This speed will vary from 9000 to 12000 feet per minute depending upon the diameter of the blade and the aggregate being cut.

Concrete blades used for this purpose have diamond cutting edges and are very expensive, costing about $1,200. If the blade is operated at other than an optimum speed, the cutting edge will wear down at a much more rapid rate thus dramatically increasing the cost of operation.

In the devices of the prior art the surface speed of the blade and the transverse speed of the saw platform are manually controlled by the operator so that when varying densities of the material being cut are encountered, the judgment of the operator is relied upon to slow the transverse movement of the saw platform or to modify the speed of the blade, or both, and, of course, the manner in which this is done will vary from operator to operator, depending upon their experience.

SUMMARY OF THE INVENTION

This invention concerns a self-propelled saw blade unit in which the surface speed of the blade edge is maintained at an optimum speed, regardless of the density of the concrete or reinforcing bars through which it is cutting, by automatically controlling the speed of the motor propelling the platform on which the saw blade is supported.

Two versions of the invention are disclosed. In one, the operator rides on the platform and the diesel engine prime mover is 155 horsepower. This is used for extremely heavy duty cutting through concrete that is up to 20 inches in thickness. Another version of the invention consists of a smaller unit in which the operator walks behind the unit. This is a lower powered unit using an 80 horsepower diesel engine and can cut concrete up to ten inches in thickness.

It is therefore an object of this invention to provide a self-propelled saw blade in which the longitudinal movement of the blade through concrete will vary, depending upon the density of the concrete encountered, with the rotational speed of the blade being maintained constant.

Another object of this invention is to provide such a machine in which the motors causing the saw blade to rotate and causing the platform supporting the saw blade to move are hydraulically driven.

These together with other objects and advantages of the invention will become apparent in the details of construction and operation as more fully described hereinafter and claimed, reference being had to the accompanying drawings forming a part hereof wherein like numerals refer to like parts throughout.

BRIEF DESCRIPTION OF THE DRAWINGS

FIG. 1 is a side elevation view of the concrete saw embodying applicant's invention, which is of a size and equipped with a sufficiently powerful engine that the operator may ride on the device and the saw blade can cut concrete up to 20 inches in thickness.

FIG. 2 is a side elevation view of the smaller version of applicant's invention in which the operator walks behind the device.

DETAILED DESCRIPTION OF THE INVENTION

Figure 3:
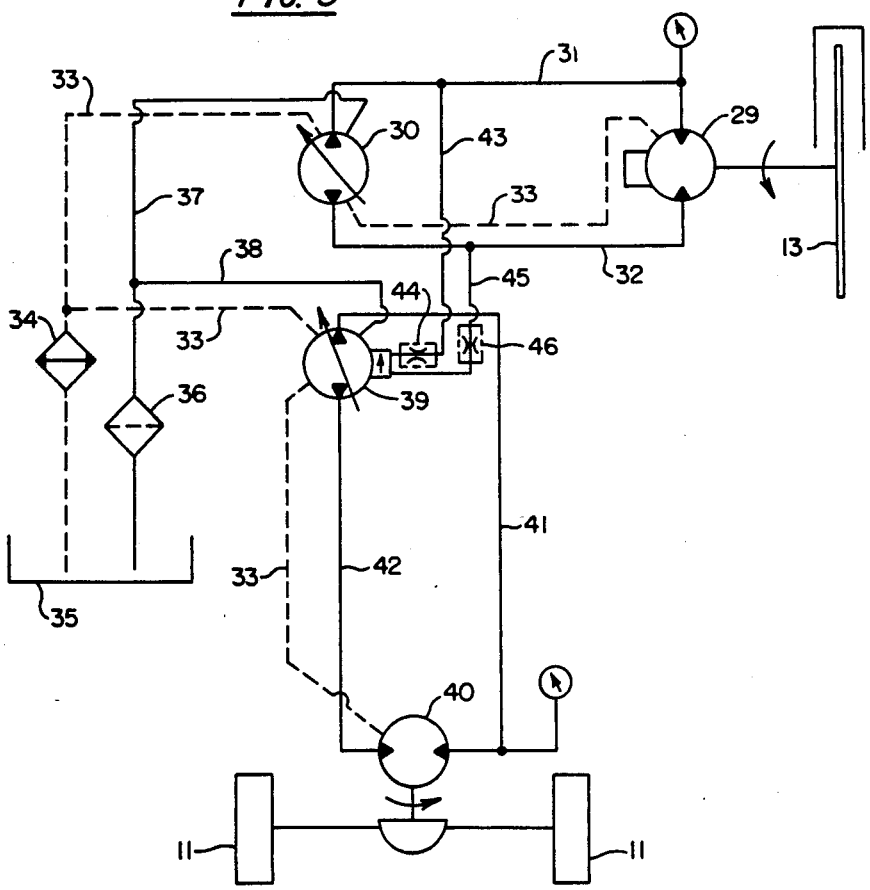
FIG. 3 is a hydraulic schematic of the control system used to control the propulsion of applicant's invention as well as the cutting speed of the saw blade.

Referring now more particularly to FIG. 1, applicant's invention comprises a motor in a housing 10 mounted on wheels 11 and 12, supporting a saw blade 13 wherein the depth of cut may be adjusted by means of threaded support 14. The blade housing and assembly 15 may be raised for transport by means of pneumatic cylinder 16 and the device is equipped with a steering wheel 17, operator's seat 18, control lever 19, warning light 20, and exhaust manifold 21.

Referring now more particularly to FIG. 2, the motor in housing 22 is mounted on a platform 23 supported by wheels 24—24. The platform 23 supports the saw blade 25 and associated cover 26. The operator controls the unit with handle 27 and power control 28.

Both of the devices shown in FIG. 1 and FIG. 2 are operated by the control system shown schematically in FIG. 3. Referring to FIG. 3, the saw blade 13 (or 25) is directly connected to hydraulic motor 29 driven by hydraulic pump 30 through pipe 31 or pipe 32, depending upon the direction of rotation desired for the saw blade 13. In order to maximize the life of the saw blade, in addition to operating at an optimum surface speed, it is desirable to reverse the blade so that during its life it is operated approximately one-half of the time in one direction and one-half of the time in the opposite direction.

Case drains 33—33 are shown which permit some of the hydraulic fluid to drain back through oil cooler 34 into the hydraulic reservoir 35. Make up hydraulic fluid is drawn from reservoir 35 through suction filter 36 and by means of lines 37 and 38 fed into pumps 30 and 39, respectively. Pump 39 is used to drive motor 40 which in turn is directly geared to the propelling wheel 11 or in the case of the device shown in FIG. 2, wheel 12. Pump 39 is connected to motor 40 through lines 41 and 42, the line used being dependent upon the direction of rotation desired. The pumps 30 and 39 are variable displacement hydraulic pumps which are bi-directional. Hydraulic line 31 is connected through line 43 and orifice 44 to the control side of the swash plate or pump 39. Line 32 is likewise connected through line 45 and orifice 46 to the same control side of the swash plate of pump 39. Orifices 44 and 46 are incorporated to prevent surges in the feedback system.

In operation, the rotational speed of the saw blade 13 is selected and manually adjusted by means of the position of the swash plate in hydraulic pump 30 which in turn drives motor 29 at the desired speed. Once the saw blade 13 is in cutting position in the concrete, the device commences to move forward, the motor 40 being controlled by the position of the swash plate in pump 39 which in turn is manually set by the operator. If the saw blade 13 encounters denser concrete or a reinforcing bar which would tend to slow its rotational speed and increase its wear, a higher pressure would be produced by pump 30 in line 31 or 32, depending upon the direction of rotation, which in turn would be transmitted either through line 43 and orifice 44 or line 45 and orifice 46 to pump 39 causing pump 39 to reduce the amount of hydraulic fluid pumped by it through lines 41 or 42, again depending upon direction of travel, to motor 40 thus slowing the speed of rotation of propelling wheels 11—11 and thus the speed of the entire assembly, thereby permitting saw blade 13 to maintain its optimal cutting speed. Likewise, if the saw blade 13 encounters less dense concrete so that it would tend to rotate at a higher speed, the same sequence of events will cause the motor 40 to speed up thus propelling the vehicle forward at a higher speed so that the speed of rotation of the saw blade 13 is maintained.

Thus, it will be seen that by the use of applicant's invention the optimum cutting speed of the saw blade 13 or 25 is maintained as the density of the concrete, macadam, or reinforcing bars encountered vary.

While this invention has been described in its preferred embodiment, it is appreciated that variations thereon may be made without departing from the proper scope and spirit of the invention.

What is claimed is:

1. A self-propelled concrete cutting saw comprising a rotary saw blade, a first hydraulic motor rotating said saw blade, said saw blade being mounted on a platform movable along the plane of the concrete, a first hydraulic pump supplying hydraulic fluid to said first hydraulic motor, a second hydraulic motor propelling said platform on which said saw blade is mounted at right angles to the axis of rotation of said saw blade, a second hydraulic pump supplying hydraulic fluid to said second hydraulic motor, means connecting said first hydraulic motor and said second hydraulic pump responsive to the hydraulic pressure in said first hydraulic motor for varying the pressure in said second hydraulic pump and thus varying the speed of movement of said platform depending upon the density of the concrete encountered by said rotating rotary saw blade, thereby varying the speed at which said saw blade is propelled at right angles to its axis of rotation, whereby the rotational speed of said saw blade is maintained within prescribed limits so as to minimize wear on said saw blade.

2. The saw of claim 1 wherein said first hydraulic pump and said second hydraulic pump are each provided with swash plates and control cylinders connected to each of said swash plates and wherein the output pressure from said first hydraulic pump is connected to the control cylinder of said second hydraulic pump.

3. The saw of claim 1 wherein said saw blade is a diamond tipped saw blade.

4. The saw of claim 1 wherein said prescribed limits are dictated by the density of the concrete being cut.

* * * * *